United States Patent [19]

Calderone

[11] Patent Number: 4,923,195

[45] Date of Patent: May 8, 1990

[54] EXERCISE DEVICE

[76] Inventor: Michael P. Calderone, 9080 Evergreen, Brighton, Mich. 48116

[21] Appl. No.: 279,835

[22] Filed: Dec. 5, 1988

[51] Int. Cl.[5] ..... A63B 21/00

[52] U.S. Cl. ..... 272/117; 272/134

[58] Field of Search ..... 272/117, 118, 134, 143, 272/DIG. 4

[56] References Cited

U.S. PATENT DOCUMENTS

| | | | |
|---|---|---|---|
| 3,285,070 | 6/1963 | McDonough . | |
| 3,573,865 | 10/1968 | Annas et al. . | |
| 3,858,873 | 1/1975 | Jones . | |
| 4,266,766 | 5/1981 | Calderone | 272/117 |
| 4,563,003 | 1/1986 | Bugallo et al. | 272/118 |
| 4,627,614 | 12/1986 | De Angeli | 272/117 |
| 4,757,992 | 7/1988 | Heitsch et al. | 272/118 X |
| 4,784,384 | 11/1988 | Deola | 272/134 X |

*Primary Examiner*—Robert W. Bahr

*Attorney, Agent, or Firm*—Basile and Hanlon

[57] ABSTRACT

An apparatus for the development of upper body parts and muscles is disclosed. The apparatus includes a base on which is mounted a seat supported above the base with an adjustable forearm pad which is adjustably disposed forward of the seat and supported above the base by an adjustable forearm pad support. A pivoted lever is pivoted at a first end adjacent the seat, a second end of the lever, extends past the forearm pad a distance and includes a weight supporting pin which extends vertically upward. A lifting device is selectively and pivotally attached to the pivoted lever, including mechanisms for adjusting the height and the forward or rearward position of the lifting device along the pivoted lever. A plurality of weights are selectively attached to the weight support pin to vary the amount of force required to use the lifting device and raise the weights. A variety of attachments are selectively affixed to the pivoted lever to exercise various body parts and muscles.

5 Claims, 2 Drawing Sheets

EXERCISE DEVICE

BACKGROUND OF THE INVENTION

1. Field of the Invention

The present invention relates to the field of exercise devices, and more particularly the present invention relates to the field of exercise devices for developing the upper body parts and muscles. Even more particularly the present invention relates to the field of exercise devices for developing muscles of the shoulders, upper arms, forearms, wrists and back.

2. Description of the Prior Art:

A search of issued U.S. patents in the field of muscular exercising devices and apparatus reveals U.S. Patents related to the field of the present invention but which do not anticipate nor disclose the device of the present invention. The discovered U.S. Patents relating to the present invention are discussed hereinbelow.

U.S. Pat. No. 3,573,865 discloses an exercise device wherein the user pushes against an arcuately movable pedal which is connected through a mechanism to pivot a weighted beam about a fixed forearm. A seat is provided against which the user of the device rests while employing the device. This device employs cables and pulleys in its operation.

U.S. Pat. No. 3,858,873 discloses an apparatus for development of body parts. The apparatus includes a frame on which is mounted a force applying member against which the user exerts a force for developing body parts and muscles. The device employs a seat for supporting the user, and a system of cables and pulleys is employed to exert force against the force applying member. The force exerted is continuously varied over the full range of rotation of the force applying member.

U.S. Pat. No. 3,285,070 discloses an exercise apparatus employing a hinged weighted arm affixed to one end of a table or support. Resistance against motion is provided by a clutch which is adjustable to vary the amount of resistance imposed.

U.S. Pat. No. 4,266,766, issued to the inventor of the herein disclosed invention and incorporated by reference herein, discloses an exercise apparatus including a base on which is mounted a seat supported above the base and a forearm pad support fixedly mounted to the base. A pivoted lever is pivoted at a first end to a seat support, and a second end of the lever extends past the forearm pad a distance and includes a weight supporting pin which extends vertically upward. The pivoted lever has fixedly mounted thereto a "U" shaped bracket and a lifting device is pivotally attached thereto. A plurality of weights are selectively attached to the weight support pin to vary the amount of force required to use the lifting device and raise the weights. A variety of attachments are selectively affixed to the lifting device to exercise various body parts and muscles. The only adjustment that can be made to the position of the forearm pad is to raise and lower it. Likewise, since the "U" shaped bracket is fixedly mounted to the pivoted lever, the only adjustment that can be made in the position of the lifting device is to raise or lower the height of the selected attachment fixed thereto.

SUMMARY OF THE INVENTION

The exercise device of the present invention comprises a base resting on a floor, a seat supported above the base, and an adjustable forearm pad adjustably disposed forward of the seat and supported above the base by an adjustable forearm pad support. A pivoted lever is pivoted at a first end to a seat support and includes the second end extending past the forearm pad a distance. A weight support pin extends vertically upward from the lever second end, and weights are provided which can be slid over the pin to vary the amount of weight employed in using the exercise device. The pivoted lever has means for pivotally attaching an attachment post at a selected position along the pivoting lever forward of the forearm rest. The attachment post has affixed thereto any of a plurality of lifting means and its height may be adjusted. The forward or rearward position of the forearm pad and support may be adjusted, and means are provided for adjusting the height of the pad. The position of the forearm pad may also be adjusted radially around the forearm pad support. In use, the user may grasp the lifting means in a palms up wrist curl attitude, a palms down wrist curl attitude, or in a palms facing each other attitude depending upon which attachment post is selected.

For a more complete understanding of the present invention reference is made to the following detailed description and accompanying drawing.

BRIEF DESCRIPTION OF THE DRAWINGS

In the drawing, like reference numbers refer to like parts throughout several views, and wherein.

DETAILED DESCRIPTION OF THE DRAWINGS

Figure 1:
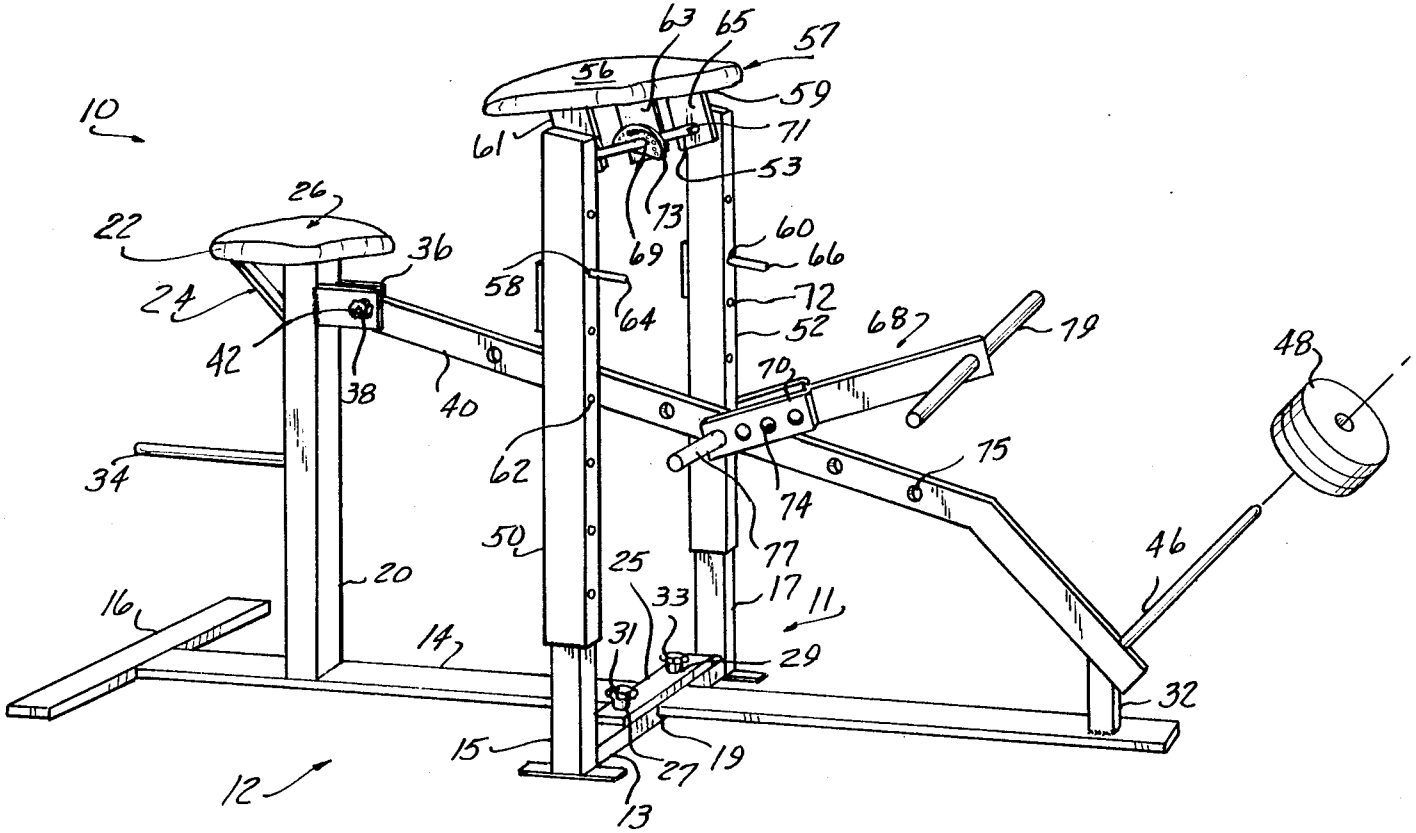
FIG. 1 illustrates a perspective view of the exercise device of the present invention.

Referring now to the drawings, and in particular to FIG. 1, wherein there is illustrated at 10 a perspective view of the preferred embodiment of the exercise device of the present invention. The exercise device of the present invention comprises a base 12 of welded construction made from square cross section tubing. The base 12 further comprises a longitudinal bar 14 having at a rear end thereof a first cross bar 16 welded thereto. A seat support 20 is vertically attached to the longitudinal bar 14 spaced forward of the first cross bar 16 by welding or other suitable means. A pad support 22 comprising a planar member deployed in a horizontal plane is affixed to the top portion of the seat support 20 by welding or other suitable means. The bracket 24 extends at an angle between the pad support and the seat support to add stability to the pad support. The padded seat 26 overlays the pad support 22 to render comfort to a person sitting thereon. A pivot stop 32 extends vertically upward at a forward end of the longitudinal bar 14 to support a forward end of a pivoted lever 40 which will be described subsequently.

A weight holding pin 34 extends rearward from the seat support 20 and is positioned beneath the pad support 22 and affixed to the seat support 20 by welding or other suitable means to provide a place to store a plurality of weights 48. A "U" shaped bracket 36 having a pair of opposed legs is attached to the seat support 20 by welding or other suitable means proximate the pad support 22 with the legs facing forward. A pair of aligned apertures 38 pass transversely through the legs of the "U" shaped bracket 36. The pivoted lever 40 comprises a longitudinal member extending from the seat support 20 and the forward end of the longitudinal bar 14. A lever aperture (not shown) is formed transversely through a rear end thereof. The lever aperture is aligned with a pair of aligned apertures 38 and a pivot pin 42 is forced into engagement with the pair of aligned apertures 38 and slidingly engaged with the lever aperture to pivotally support the pivoted lever 40 to the "U" shaped bracket 36. A weight support pin 46 is vertically affixed to the forward end of the pivoting lever 40 and is configured to selectively support the plurality of weights 48. A central aperture of the weights is slid over the pin 46 to retain the weights. The weight holding pin 34 is employed to store and support weights which are not placed over the weight supporting pin 46. A forward end of the lever rests on the pivot stop 32 when the weights are not being lifted.

An adjustable forearm pad 56 is adjustably disposed forward of the seat 26 and is supported above the longitudinal bar 14 by an adjustable forearm pad support generally designated 11. The adjustable forearm pad support 11 is comprised of a second cross bar 13 extending transversely to the longitudinal bar 14 beneath the forearm pad and a pair of opposed vertical supports 15, 17 extending vertically upward from the ends of the second cross bar 13 to the forearm pad 56. The adjustable forearm pad support 11 is also of welded construction made from square cross section tubing. The second cross bar 13 has disposed in its center upward surface a notch 19 adapted to receive longitudinal bar 14. A pair of threaded apertures (not shown) are located adjacent each side of the notch 19. The adjustable forearm pad support 11 further comprises a flat, plate-like member 25, with a pair of apertures 27, 29 formed therein and configured to be aligned with the pair of threaded apertures. A pair of large-headed threaded fasteners 31, 33 formed at one end with a head adapted to be turned by hand, said head exceeding the diameter of the threaded apertures, is provided. In use, the second cross bar 13 is placed under and at right angles to longitudinal bar 14 in such a manner that longitudinal bar 14 is received by notch 19. The plate-like member 25 is placed on top of and parallel to second cross bar 13, the assembly thereby containing longitudinal bar 14. The threaded apertures (not shown) located proximate each side of notch 19 are aligned with apertures 27, 29 formed in the plate-like member 25, and threaded fasteners 31, 33 are threaded through apertures 27, 29 and threadingly engaged with the threaded apertures. The position of forearm pad support 11 along the axis of longitudinal bar 14 is adjusted to a selected position forward or rearward. Threaded fasteners 31, 33 are turned by hand until plate-like member 25 is forced down against second cross bar 13 so as to fix forearm pad support 11 to longitudinal bar 14 at the selected position to define a means for adjusting the forward position of the forearm pad.

A pair of opposed vertical sleeves 50, 52 telescopingly engage the pair of opposed vertical supports 15, 17, and a forearm pad support tube 53 disposed in a horizontal plane extends between the opposed vertical sleeves 50, 52 and is joined thereto by welding or other suitable means. Attached to the under surface of a forearm pad 56 is a bracket 57 comprising a flat cross-piece 59 and a plurality of arms 61, 63, 65 extending perpendicularly therefrom. Arms 61, 63, 65 each have an aperture 67, 69, 71 formed therein proximate the end opposite the flat cross piece 59. Apertures 67, 69, 71 are adapted to slidingly engage forearm pad support tube 53. A lock pin 73 is supported from the cross piece 59. The lock pin 73 passes through an aperture in arm 63 and engages one of the apertures 120 in a plate 122 fixed to support tube 53 to fix the forearm pad 56 to the forearm pad support tube 53 at a pre-selected position to define a means for adjusting the radial position of the forearm pad. A pair of aligned apertures 58, 60 pass transversely through the vertical sleeves 50, 52 and are selectively aligned with a plurality of spaced aligned apertures 62, 63 which pass transversely through the pair of opposed vertical supports 15, 17, and a pair of pins 64, 66 slidingly engage the apertures 58, 60 and 62, 72 respectively to selectively position the forearm pad 56 at a desired height and define a means for adjusting the height for the forearm pad.

The pivoted lever 40 further comprises a plurality of spaced and aligned apertures 75. An attachment post 68 comprises a pivoting bar 70 and a lifting means 79. The pivoting bar 70 further comprises a plurality of spaced and aligned apertures 74. Attachment post 68 is pivotally attached to the pivoted lever 40 by means of lock pin 77 which engages one of the apertures 74 in the pivoting bar 70 with one of the apertures 75 in the pivoted lever 40. In this manner, both the height of attachment post 68 and its position forward or rearward along the axis of the pivoted lever 40 can be selected to define a means for adjusting the height and forward position of the lifting means.

Figure 2:
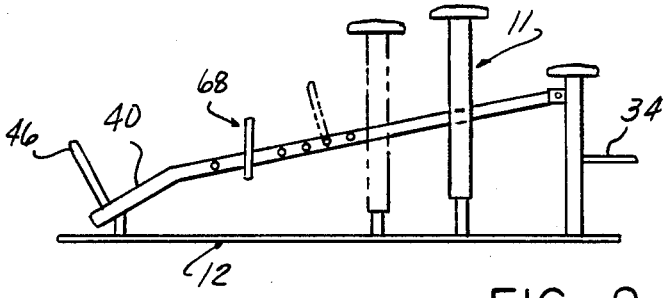
FIG. 2 illustrates the exercise device in another configuration created by adjusting the position and height of the attachment post on the pivoting lever and the forward position and height of the forearm pad and support.

FIG. 2 illustrates an embodiment of the present invention in which the positions of various adjustable components have been shifted relative to their positions in FIG. 1 which are shown in phantom for comparison purposes. The height of the forearm pad has been raised and that of the lifting means lowered. The position of the forearm pad has been shifted reward and that of the lifting means forward.

Figure 3A:
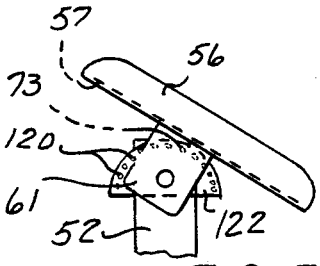
FIGS. 3*a*, 3*b* and 3*c* illustrate three possible positions of the forearm support.
Figure 3B:
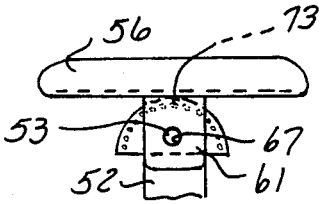
Figure 3C:
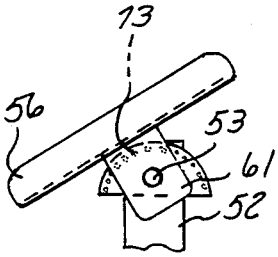

FIGS. 3*a*, 3*b* and 3*c* illustrate three possible radial positions of the forearm pad. In FIG. 3*a*, the pad is facing rearward toward the user at about at 30° angle from the horizontal. In FIG. 3*b*, the pad is in a substantially horizontal position. In FIG. 3*c*, the pad faces forward away from the user at about a 30° angle from the horizontal.

Figure 4:
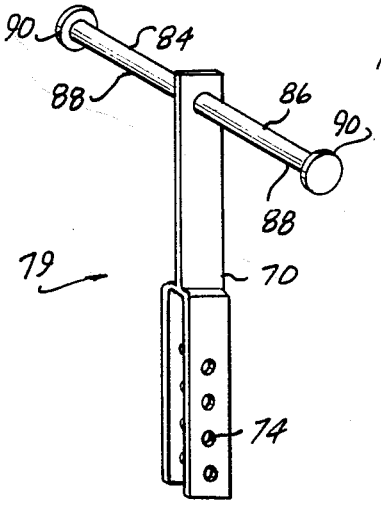
FIG. 4 illustrates a palms up wrist curl attachment.

The lifting means 79 in the embodiment of the present invention illustrated in FIG. 1 comprises a palms up wrist curl attachment, illustrated in more detail in FIG. 4. Referring now to FIG. 4, the palms up wrist curl attachment 79 comprises a pair of cross pins 84, 86 affixed to the end of the pivoting bar 70 opposite the plurality of spaced and aligned apertures 74 and extending horizontally and transversely from the pivoting bar 70. A first pair of tubes 88 slidingly engage the cross pin 84, 86, and a threaded aperture formed in an outward end of each cross pin threadingly receives a large-headed threaded fastener 90 to retain the tube thereon.

Figure 5:
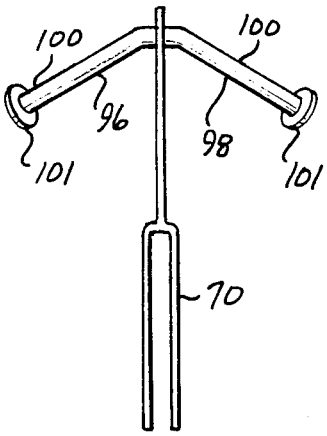
FIG. 5 illustrates a palms down wrist curl attachment.

In another embodiment of the present invention, lifting means 79 comprises a palms down wrist curl attachment illustrated in detail in FIG. 5. Referring to FIG. 5, the palms down wrist curl attachment comprises a second pair of cross pins 96, 98 affixed to the pivoting bar 70 extending transversely outward and downward therefrom. A second pair of tubes 100 slidingly engage the cross pins 96, 98. A threaded aperture (not shown) formed in an outward end of each of the cross pins threadingly engages a large-headed threaded fastener 101 having a round head exceeding the sleeve diameter to retain the tubes in position.

Figure 6:
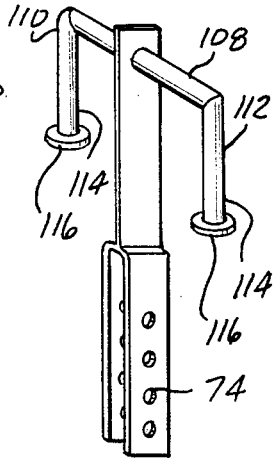
FIG. 6 illustrates a palms facing each other attachment.

In another embodiment of the herein described invention, lifting means 79 comprises a palms facing each other lifting means which is illustrated in detail in FIG. 6. Referring to FIG. 6, the palms facing each other lifting means comprises a cross member 108 affixed at an upper end of the pivoting bar 70 and extending transversely outward therefrom. A pair of downward extending pins 110, 112 are affixed to the outer ends of the cross member 108, and a pair of sleeves 114 slidingly engage the downward extending pins. A threaded aperture formed in a bottom of each of the downward extending pins (not shown) receives the threaded end of a large-headed threaded fastener 116 having a round head exceeding the diameter to retain the tubes thereon.

There has been described herein above an exercise device for selectively developing the muscles of the user's upper body including the user's arms, back, wrists and shoulders. The device provides adjustment of the height of the forearm pad support and the lifting means, in the forward or rearward position of the forearm pad, forearm pad support and the lifting means, and in the radial position of the forearm pad. A plurality of hand engaging lifting means are provided which can be selectively used to provide a palms up wrist curl attachment, a palms down wrist curl attachment, and a palms facing each other lifting attachment.

While the invention has been described with respect to certain embodiments and exemplifications herein, it is not intended to be limited thereby but solely by the claims appended hereto.

I claim:

1. An exercise device for selectively developing the muscles of the user's arms, wrists and shoulders comprising:

a base;

a seat supported above the base;

an adjustable forearm pad adjustably disposed forward of the seat and supported above the base by an adjustable forearm pad support;

a pivoted lever pivoted at a rearward end adjacent the seat, a forward end extending past the forearm pad a distance;

a longitudinal bar including a rear end rearward of the seat, and a front end terminating forward of the forearm pad;

a first cross-bar extending transversely to the longitudinal bar at the rear end;

a pivot stop extending vertically upward from the forward end of the longitudinal bar to support the pivoted lever at rest;

a seat support extending vertically from the longitudinal bar to the seat;

a weight holding pin extending horizontally from the seat support between the base and the seat;

a first "U" shaped bracket affixed to the seat support with an open end extending forward;

a lever aperture formed in the rearward end of the pivoted lever, a pair of aligned apertures formed in the bracket aligned with the lever aperture, a pivot pin engaging the pair of apertures and the lever aperture to form a pivot;

a second cross-bar extending transversely to the longitudinal bar vertically beneath the forearm pad;

a pair of opposed vertical supports extending vertically upward from the ends of the second cross-bar to the forearm pad;

a notch disposed in the center upper surface of the second cross-bar and adapted to receive the longitudinal bar;

a pair of threaded apertures located proximate each side of the notch;

a flat, plate-like member;

a pair of apertures formed in the plate-like member configured to be aligned with the pair of threaded apertures located proximate each side of the notch;

a pair of large-headed threaded fasteners each with a head formed at one end thereof and adapted to be turned by hand, said head exceeding the threaded aperture diameter, each threaded fastener engaging an aperture and threadingly engaging a threaded aperture to retain the plate-like member and the second cross-bar at a selected position along the longitudinal bar;

a weight supporting pin extending vertically upward from the lever forward end;

an attachment post pivotally and adjustably attached to the pivoted lever forward of the forearm pad;

a lifting means attached to the attachment post and adapted to be grasped by the user's hands; and a plurality of weights selectively attached to the weight supporting pin.

2. The exercise device as defined in claim 1 further including means for adjusting the height of the forearm pad the means comprising:

a pair of opposed vertical sleeves telescopingly engaging the opposed vertical supports;

a plurality of spaced and aligned apertures formed in the vertical supports;

a pair of aligned apertures formed in the opposed sleeves configured to be selectively aligned with a pair of aligned apertures in the vertical supports, and a pin to engage the aligned apertures affixing the sleeves to the vertical supports at a selected height; and a forearm pad support tube interconnecting an upper end of the pair of opposed vertical sleeves.

3. The exercise device as defined in claim 2 wherein the adjustable forearm pad further comprises:

a bracket affixed to the under surface thereof, said bracket comprising a flat cross-piece and a plurality of arms extending perpendicularly therefrom, each member of said plurality of arms having an aperture formed therein proximate the end opposite the flat cross-piece, said aperture being adapted to slidingly engage the forearm pad support tube; and a means of locking the adjustable forearm pad on the forearm support tube at a selected position.

4. An exercise device for selectively developing the muscles of the user's arms, wrists and shoulders comprising:

a base having a longitudinal bar including a rear end rearward of the seat, and a front end terminating forward of the forearm pad, the base further having a first cross-bar extending transversely to the longitudinal bar at the rear end;

a seat supported above the base;

an adjustable forearm pad adjustably disposed forward of the seat and supported above the base by an adjustable forearm pad support;

a pivoted lever pivoted at a rearward end adjacent the seat, a forward end extending past the forearm pad a distance;

a weight supporting pin extending substantially vertically upward from the lever forward end and adapted to receive weights thereon;

a cross-bar extending transversely to the longitudinal bar vertically beneath the forearm pad;

a pair of opposed vertical supports extending vertically upward from the ends of the second cross-bar to the forearm pad;

a notch disposed in the center upper surface of the second cross-bar and adapted to receive the longitudinal bar;

a pair of threaded apertures located proximate each side of the notch;

a flat, plate-like member;

a pair of apertures formed in the plate-like member configured to be aligned with the pair of threaded apertures located proximate each side of the notch;

a pair of large-headed threaded fasteners each with a head formed at one end thereof and adapted to be turned by hand, said hand exceeding the threaded aperture diameter, each threaded fastener engaging an aperture and threadingly engaging a threaded aperture to retain the plate-like member and the second cross-bar at a selected position along the longitudinal bar;

lifting means adapted to be grasped by the hands of the users; and means for pivotally attaching the lifting means to the pivoted lever forward of the forearm pad.

5. The exercise device as defined in claim 4 further including means for adjusting the height of the forearm pad the means comprising:

a pair of opposed vertical sleeves telescopingly engaging the opposed vertical supports;

a plurality of spaced and aligned apertures formed in the vertical supports;

a pair of aligned apertures formed in the opposed sleeves configured to be selectively aligned with a pair of aligned apertures in the vertical supports, and a pin to engage the aligned apertures affixing the sleeves to the vertical supports at a selected height; and a forearm pad support tube interconnecting an upper end of the pair of opposed vertical sleeves.

* * * * *